US005361785A

United States Patent [19]

Wu

[11] Patent Number: 5,361,785

[45] Date of Patent: Nov. 8, 1994

[54] ASH TRAY

[76] Inventor: Wu-Hsiung Wu, No. 9, Lane 202, Sec. 2, Chung-I Rd., Tainan City, Taiwan, Prov. of China

[21] Appl. No.: 116,408

[22] Filed: Sep. 3, 1993

[51] Int. Cl.[5] ..... A24F 13/18; A24F 13/22

[52] U.S. Cl. ..... 131/235.1; 131/241; 131/242

[58] Field of Search ..... 131/235.1, 256, 231, 131/240.1, 241, 242

[56] References Cited

U.S. PATENT DOCUMENTS 2,268,149 12/1941 Hinkle ..... 131/235.1 X
2,595,103 4/1952 Schmaling ..... 131/242
2,965,108 12/1960 Schlatterer ..... 131/256
4,886,076 12/1989 Gilbert et al. ..... 131/235.1 X
5,085,230 2/1992 Roman ..... 131/235.1

*Primary Examiner*—Jennifer Bahr
*Attorney, Agent, or Firm*—Ladas & Parry

[57] ABSTRACT

A domed casing includes a flat base and a rounded roof portion provided on the flat base to define an internal space in the domed casing. The rounded roof portion has a tapered through-hole formed therethrough in which a spiral coil is engaged. The spiral coil has a first end engaged in the tapered through-hole and a second end which extends into the internal space of the casing. The second end of the spiral coil is coiled more compactly than the first end.

1 Claim, 3 Drawing Sheets

ASH TRAY

BACKGROUND OF THE INVENTION

1. Field of the Invention

The invention relates to an ash tray, more particularly to an ash tray which is capable of reducing the smoke from a burning cigarette that is placed on the ash tray.

2. Description of the Related Art

A conventional ash tray includes a disc and a surrounding wall formed around the periphery of the disc so as to define a space for receiving cigarette ash and cigarette butts therein. The surrounding wall is formed with a curved notch at a periphery thereof. A burning cigarette is placed in the conventional ash tray such that an intermediate portion of the cigarette is supported by the curved notch of the surrounding wall so that a filter end of the cigarette extends out of the conventional ash tray while the burning end of the same rests above the disc of the conventional ash tray.

Some of the drawbacks resulting from the use of the conventional ash tray are as follows:

(I) When a burning cigarette is placed on the conventional ash tray, smoke is produced around the conventional ash tray, thus polluting the nearby environment.

(II) When a burning cigarette is placed in the conventional ash tray, the cigarette occasionally slips from the curved notch of the conventional ash tray.

(III) When a cigarette which has slipped from the conventional ash tray is picked up, ash adheres on the smoking end of the cigarette. Thus, the smoker has to wash his hands before puffing, thereby inconveniencing the smoker.

Presently, there are some modified ash trays which can remedy the above-mentioned drawbacks and provide additional advantages, such as filtering nicotine from the smoke. However, the structure of the modified ash trays is too complicated when compared to the conventional ash tray. This results in a relatively complicated process and in higher manufacturing costs.

SUMMARY OF THE INVENTION

Therefore, a main objective of the present invention is to provide an ash tray which is capable of reducing the smoke from a burning cigarette that placed thereon.

A second objective of the present invention is to provide an ash tray which has a means to support a cigarette when the latter is disposed thereon so that the cigarette will not slip from the ash tray.

A third objective of the present invention is to provide an ash tray which is simple in construction and which can be easily and economically produced.

Accordingly, the ash tray of the present invention includes a hollow casing that has a base with a flat seating plane and a roof portion which is provided on the base to define an internal space of the casing. The roof portion has at least one through-hole and a spiral coil that has a first end engaged in the through-hole and a second end extending into the internal space. The second end of the spiral coil is more compactly coiled than the first end.

The through-hole can be formed perpendicularly or inclinedly with respect to the flat seating plane of the base. When a burning cigarette is inserted into the through-hole of the ash tray such that a burning section of the cigarette is engaged in the compactly coiled second end of the spiral coil, an ascending route for the smoke of the cigarette is partially blocked by the perpendicularly or inclinedly disposed cigarette itself while the ventilation for keeping the burning section fully burning is also partially blocked by the compactly coiled second end of the spiral coil. Thus, the cigarette lacks fresh air to keep the burning end wholly burning. The burning end of the cigarette is, therefore, partially ignited with a faint fire so that the smoke that is produced is less when compared to a cigarette disposed in the conventional ash tray.

To prevent an inserted cigarette from falling into the internal space of the hollow casing, the orientation of the through-hole is preferably inclined. Then, the spiral coil can be disposed inclinedly. The bottom end of the inserted cigarette can engage an upper section of the second end of the spiral coil so as to hold the inserted cigarette in the spiral coil without the need for providing an engaging means at the second end of the spiral coil. More preferably, the spiral coil is shaped as a truncated cone and has a series of coil turns, the diameters of which being reduced gradually from the first end to the second end of the spiral coil. The diameter at the first end of the spiral coil is slightly larger than a diameter of a common cigarette, while the diameter at the second end of the spiral coil is smaller than the common cigarette. Under this condition, the cigarette can be easily inserted into and engaged stably in the spiral coil, thereby preventing the cigarette from falling down from the roof portion of the ash tray or from slipping into the internal space via the second end of the spiral coil. The spiral coil further has a series of pitches that are reduced gradually from the first end to the second end.

More preferably, the through-hole is tapered and has a top end and a bottom end which has a diameter that is smaller than that of the top end. In addition, the diameter of the top end of the through-hole is slightly larger than that of the first end of the spiral coil, while the diameter of the bottom end of the through-hole is slightly larger than that of the second end of the spiral coil. Under such a condition, the first end of the spiral coil can be engaged in the inclinedly oriented through-hole without the need of any positioning unit while the second end of the spiral coil is inserted into the internal space of the hollow casing.

The hollow casing is, preferably, dome-shaped, and has a circular flat base and a rounded roof portion. A central opening is formed at an apex of the rounded roof portion so that cigarette ash and cigarette butt can be disposed into the internal space of the domed casing via the central opening.

More preferably, the rounded roof portion further comprises a funnel member that has a first end with a diameter which is smaller than that of the central opening and a second end with a diameter which is larger than that of the central opening. The funnel member is disposed in the central opening such that the first end extends into the internal space of the domed casing. The funnel member is a wall body in the shape of a truncated cone and preferably has at least one through-hole formed through the wall body. The through-hole of the wall body has an axis oriented substantially perpendicular to the flat seating plane of the base. The through-hole of the wall body has a top opening and a bottom opening. The size of the top opening is slightly larger than that of a common cigarette, while the size of the bottom opening is slightly smaller than the common cigarette. When the burning end of a cigarette is inserted into the through-hole of the wall body, the burning end will be extinguished after an interval of time since it lacks the necessary fresh air to keep on igniting and due to reasons explained at the preceding paragraphs.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
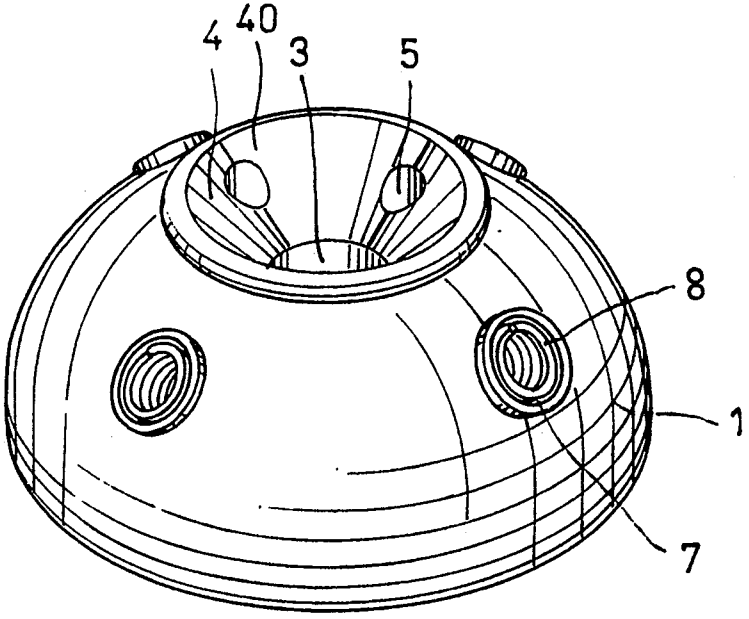
FIG. 1 shows a perspective, schematic view of an ash tray of the present invention.
Figure 2:
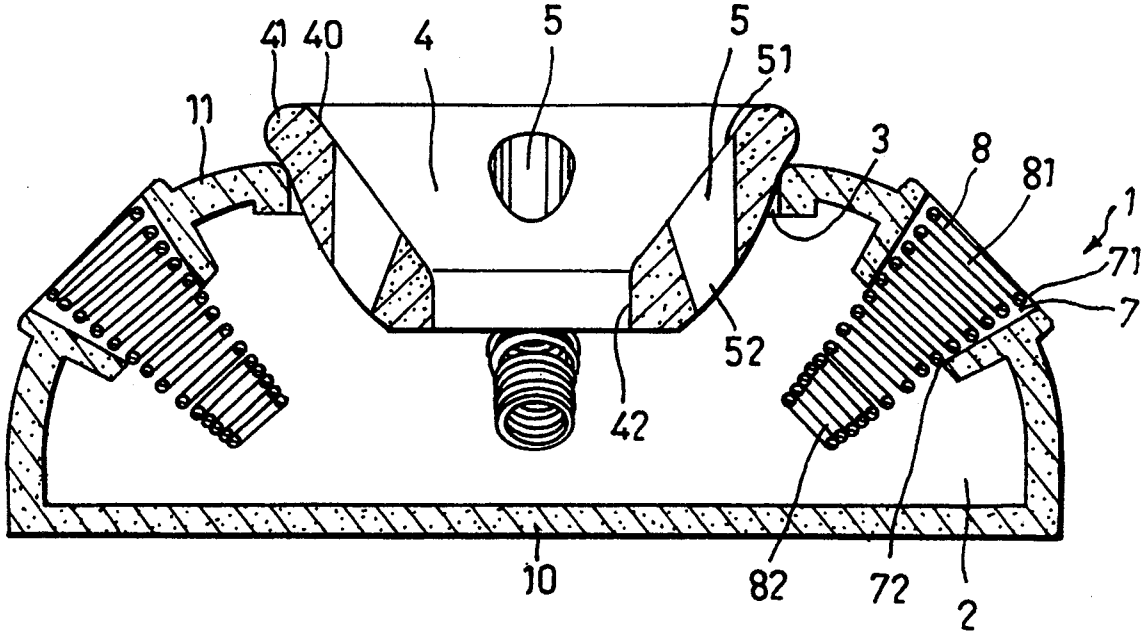
FIG. 2 is a cross sectional view of the ash tray of FIG. 1.

Referring to FIGS. 1 and 2, an ash tray of the present invention includes a domed casing 1 that has a circular flat seating base 10 and a rounded roof portion 11 provided on the circular base 10 so as to define an internal space 2 of the ash tray.

The rounded roof portion 11 has a central opening 3 formed at an apex. The rounded roof portion 11 further comprises a funnel member 4 disposed in the central opening 3. The funnel member 4 has a first end 42 which extends into the internal space 2 of the domed casing 1 and a second end 41. The diameter of the first end 42 of the funnel member 4 is smaller than that of the central opening 3 while the diameter of the second end 41 is greater than that of the central opening 3. The funnel member 4 is a wall body 40 which is in the shape of a truncated cone and has three through-holes 5 formed therethrough. Each of the through-holes 5 has an axis that is substantially perpendicular to the circular flat base 10. The through-hole 5 of the wall body 40 has a top opening 51 and a bottom opening 52. The size of the top opening in 51 is slightly larger than that of a common cigarette, while the size of the bottom opening 52 is slightly smaller than that of the common cigarette.

The rounded roof portion 11 further has three tapered through-holes 7 formed around the central opening 3. The tapered through-holes 7 are inclined with respect to the circular flat seating base 10. Each of the tapered through-holes 7 has a top end 71 and a bottom end 72. The diameter of the top end 71 is larger than that of the bottom end 72. Three spiral coils 8, each being in the shape of a truncated cone, has a series of coil turns with diameters that are reduced gradually from the first end 81 to the second end 82. The spiral coil 8 further has a series of pitches which are reduced gradually from the first end 81 to the second end 82. Thus, the second end 82 is coiled more compactly than the first end 81. The diameter of the first end 81 of the spiral coil 8 is a slightly larger than a diameter of a common cigarette while the diameter of the second end 82 is smaller than the diameter of the common cigarette. When the spiral coil 8 is inserted in the tapered through-hole 7, the first end 81 of the spiral coil 8 engages the tapered through-hole 7 without the need for any positioning unit, while the second end 82 of the spiral coil 8 extends into the internal space 2 of the domed casing 1 because the diameter of the top end 71 of the tapered through-hole 7 is slightly larger than that of the first end 81 of the spiral coil 8 and the diameter of the bottom end 72 of the tapered through-hole 7 is slightly larger than that of the second end 82 of the spiral coil 8.

Figure 3:
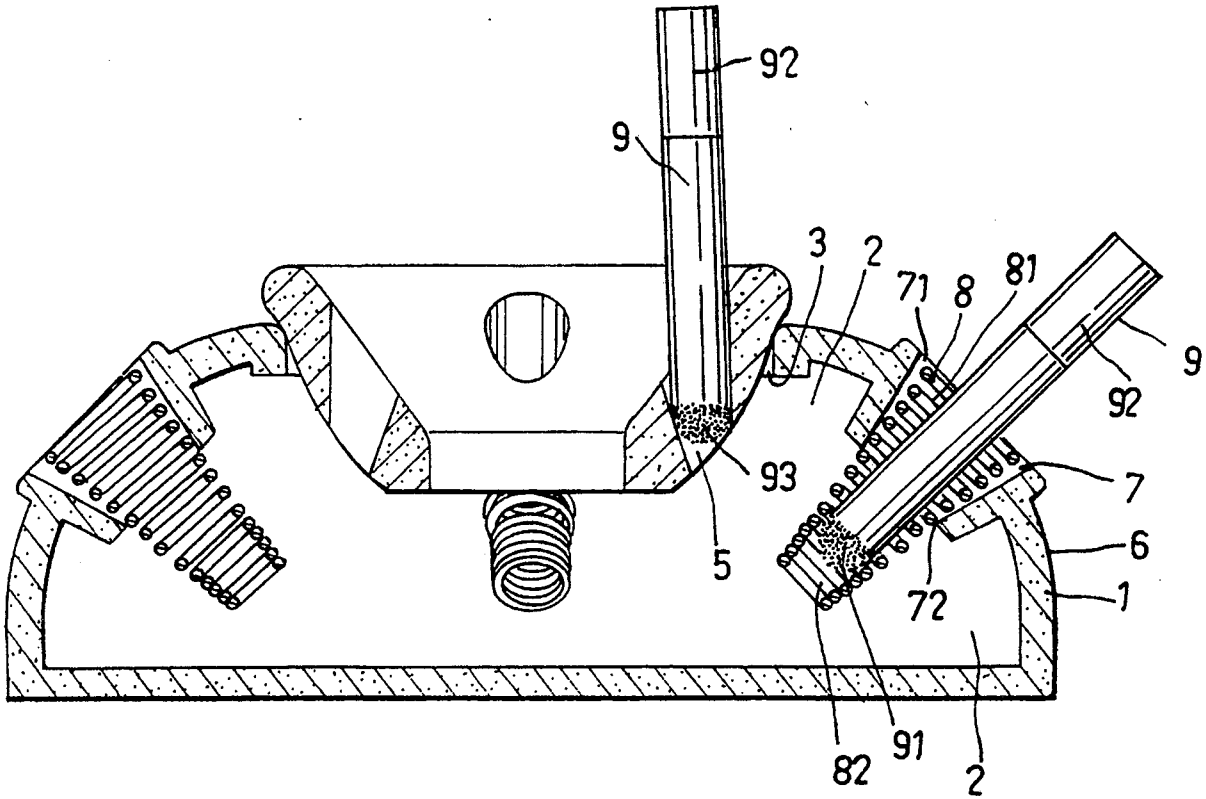
FIG. 3 illustrates the ash tray of the present invention when in use.

Referring to FIG. 3, when a burning cigarette 9 is inserted into the spiral coil 8 through the tapered through-hole 7, a burning section 91 of the cigarette 9 is engaged stably in the compactly coiled second end 82 of the spiral coil 8. The cigarette 9 is, thus, prevented from slipping off the domed casing 1 or from sliding into the internal space 2 of the domed casing 1. Note that under such a condition, an ascending route for smoke from the cigarette 9 is blocked partially by the stem of the inclinedly inserted cigarette 9, while the ventilation for continuously igniting fully the burning section 91 of the same is partially blocked by the compactly coiled second end 82 of the spiral coil 8. Therefore, the cigarette 9 lacks the necessary fresh air to keep the burning section 91 fully ignited and thus, only a faint fire is left at the burning section 91. The cigarette 9 that is inserted in the ash tray of the present invention thus produces less smoke than when it is disposed in the conventional ash tray.

In a similar manner, the burning end 93 of a cigarette can be inserted into the through-hole 5 of the wall body 40 in order to extinguish the same. Note that the burning end 93 of the cigarette is extinguished after a short period of insertion, due to lack of fresh air and to other reasons explained in the preceding paragraphs. In addition, cigarette ash and cigarette butts can be put into the internal space 2 of the domed casing 1 via the central opening 3.

The ash tray of the present invention can prevent soiling of the fingers of a smoker since it obviates the need for rubbing the burning end of a cigarette against an article to extinguish the fire.

While a preferred embodiment has been explained and described, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. An ash tray comprising a dome-shaped hollow casing including a base with a flat seating plane and a rounded roof portion provided on said base to define an internal space in said hollow casing, said roof portion having at least one tapered through-hole formed therethrough and an apex formed with a central opening, said through-hole oriented inclinedly with respect to said flat seating plane, and at least one spiral coil having a first end engaged in said through-hole and a second end extending into said internal space, said spiral coil being shaped as a truncated cone and having a series of coil turns with diameters that are reduced gradually from said first end to said second end, and a series of pitches that are reduced gradually from said first end to said second end, wherein said rounded roof portion further comprises a funnel member that has a first open end and a second open end which has a diameter smaller than that of said first open end, said funnel member being fixed in said central opening such that said second open end extends into said internal space, said funnel member including a wall body formed as a hollow truncated cone, said wall body having at least one through-hole formed therethrough, said through-hole of said wall body being formed as a truncated cone with a top end and a bottom end.

* * * * *